US008820671B2

(12) United States Patent
Chambers et al.

(10) Patent No.: US 8,820,671 B2
(45) **Date of Patent: *Sep. 2, 2014**

(54) REEL ASSEMBLIES WITH CUSTOMIZABLE AND INTERCHANGEABLE DRUMS

(71) Applicant: Southwire Company, LLC, Carrollton, GA (US)

(72) Inventors: Terry C. Chambers, Carrollton, GA (US); Herbert Forrister, Jr., Carrollton, GA (US)

(73) Assignee: Southwire Company, LLC, Carrollton, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/041,350

(22) Filed: Sep. 30, 2013

(65) Prior Publication Data

US 2014/0027562 A1 Jan. 30, 2014

Related U.S. Application Data

(63) Continuation of application No. 12/905,550, filed on Oct. 15, 2010, now Pat. No. 8,544,786.

(60) Provisional application No. 61/253,614, filed on Oct. 21, 2009.

(51) Int. Cl.
*B65H 75/22* (2006.01)

(52) U.S. Cl.
USPC ..... 242/609; 242/608.4; 242/118.6

(58) Field of Classification Search
CPC ..... B65H 75/12; B65H 75/14; B65H 75/22
USPC ..... 242/599.4, 600, 608.4, 609–609.3, 613, 242/118, 118.4, 118.6, 118.61, 118.62
See application file for complete search history.

(56) References Cited

U.S. PATENT DOCUMENTS

| | | | |
|---|---|---|---|
| 1,905,488 | A | 4/1933 | Nack |
| 1,915,825 | A | 6/1933 | Hescock |
| 2,061,365 | A | 11/1936 | Markle, Jr. |
| 2,225,551 | A | 12/1940 | Clinton |

(Continued)

FOREIGN PATENT DOCUMENTS

| | | | |
|---|---|---|---|
| FR | 2674233 | A1 | 9/1992 |
| WO | 9412422 | A1 | 6/1994 |

OTHER PUBLICATIONS

U.S. Office Action dated Dec. 27, 2012 in U.S. Appl. No. 12/905,550.

(Continued)

*Primary Examiner* — William E Dondero
(74) *Attorney, Agent, or Firm* — Hartman & Citrin LLC

(57) ABSTRACT

Methods, systems, and apparatus are described herein for using reel assemblies including customizable and interchangeable drums. According to embodiments described herein, a reel assembly includes a first flange having a bolt pattern and a second flange having the bolt pattern. The reel assembly also includes a core drum having a first end and a second end. The first and second ends of the reel assembly also have the bolt pattern. The first end of the reel assembly is detachably coupled to the first flange via the bolt pattern, and the second end of the reel assembly is detachably coupled to the second flange via the bolt pattern.

8 Claims, 9 Drawing Sheets

(56) References Cited

U.S. PATENT DOCUMENTS

| | | | | |
|---|---|---|---|---|
| 2,285,732 | A | 6/1942 | Markle, Jr. | |
| 2,397,362 | A | 3/1946 | Markle, Jr. | |
| 2,494,521 | A | 1/1950 | Schaefer et al. | |
| 2,881,985 | A | 4/1959 | Overmire et al. | |
| 3,056,563 | A | 10/1962 | Whitnah | |
| 3,970,268 | A | 7/1976 | Sheetz | |
| 4,039,156 | A | 8/1977 | Abraham | |
| 4,066,224 | A | 1/1978 | Hargreaves et al. | |
| 5,605,305 | A | 2/1997 | Picton | |
| 5,803,396 | A | 9/1998 | Dewaele | |
| 5,971,317 | A | 10/1999 | Jaros | |
| 6,352,216 | B1 | 3/2002 | Coats | |
| 6,478,249 | B1 | 11/2002 | Orzel | |
| 8,544,786 | B2 * | 10/2013 | Chambers et al. | 242/609 |
| 8,608,102 | B2 | 12/2013 | Brennaman | |

OTHER PUBLICATIONS

U.S. Notice of Allowance dated May 28, 2013 in U.S. Appl. No. 12/905,550.

U.S. Appl. No. 13/225,948 Office Action mailed Feb. 19, 2014.

* cited by examiner

REEL ASSEMBLIES WITH CUSTOMIZABLE AND INTERCHANGEABLE DRUMS

CROSS-REFERENCE TO RELATED APPLICATION

This application is a continuation of and claims the benefit of U.S. Non-Provisional patent application Ser. No. 12/905,550, filed on Oct. 15, 2010, now U.S. Pat. No. 8,544,786 and entitled "Reel Assemblies with Customizable and Interchangeable Drums", which is a non-provisional of and claims priority to U.S. Provisional Patent Application No. 61/253,614, filed on Oct. 21, 2009, entitled "Reel Assemblies with Customizable and Interchangeable Drums," both of which are expressly incorporated herein by reference in their entireties.

BACKGROUND

Wire, cable, conduit, and armored cable are typically loaded on reels to be transported. Such reels usually include a drum upon which the wire, cable, conduit, or armor cable is wound around and two flanges flanking either end of the drum. Most wire, cable, conduit, and armored cable are associated with a bend factor which indicates the maximum each can bend before damage occurring. Thus, the outside diameter (OD) of the drum of the reel used to load the wire, cable, conduit, and/or armored cable is dictated by the bend factor of the particular wire, cable, conduit, and/or armored cable to be loaded. In some circumstances, the bend factor of a wire, for example, is twenty-two times the OD of the wire. Therefore, when selecting a reel on which to load the wire, the OD of the drum of the reel must be at least twenty-two times the OD of the wire in order to protect against damaging the wire when it is wound upon the drum.

In order to accommodate a large variety of ODs associated with wire, cable, conduit, and armored cable, reel suppliers are required to stock an inventory of reels having drums with different ODs, or suppliers have to use reels with larger drum ODs than required by a particular wire, for example, which unnecessarily drives up the overall dimensions of the reels. The larger a reel is, the more costly it is to transport the reel from one location to the next. In particular, only a small number of larger reels can fit on a flatbed truck for transportation, and larger reels often exceed the maximum height limits set by the Department of Transportation for vehicles traversing highways and require special escorts, all of which equate to higher transportation costs.

Once a reel has been paid off at a site and is ready to be transported back to the reel supplier, often only a limited number of reels can be returned on a flatbed truck because of the size of the reels. Therefore, multiple trips to return paid-off reels may have to be taken which also increases the transportation costs.

SUMMARY

It should be appreciated that this Summary is provided to introduce a selection of concepts in a simplified form that are further described below in the Detailed Description. This Summary is not intended for use in limiting the scope of the claimed subject matter.

Methods, systems, and apparatus are described herein for using reel assemblies including customizable and interchangeable drums. According to embodiments described herein, a reel assembly includes a first flange having a bolt pattern and a second flange having the bolt pattern. The reel assembly also includes a core drum having a first end and a second end. The first and second ends of the reel assembly also have the bolt pattern. The first end of the reel assembly is detachably coupled to the first flange via the bolt pattern, and the second end of the reel assembly is detachably coupled to the second flange via the bolt pattern.

According to further embodiments, a reel assembly includes a first flange having a bolt pattern and a second flange. The reel assembly also includes a core drum having a first end and a second end. The first end of the reel assembly also includes the bolt pattern. The first end of the reel assembly is detachably coupled to the first flange via the bolt pattern, and the second end of the reel assembly is coupled to the second flange.

According to other embodiments, a reel assembly is configured by attaching a first flange to a first end of a core drum. The first flange is detachably coupled to the core drum via a bolt pattern shared by the first flange and the first end of the core drum. A second flange of the reel assembly is attached to a second end of the core drum. The second flange is detachably coupled to the core drum via the bolt pattern shared by the second flange and the second end of the core drum.

Other apparatus, systems, and methods according to embodiments will be or become apparent to one with skill in the art upon review of the following drawings and Detailed Description. It is intended that all such additional methods, apparatus, and/or systems be included within this description, be within the scope of the present invention, and be protected by the accompanying claims.

DETAILED DESCRIPTION

The following detailed description is directed to methods, systems, and apparatus for using reel assemblies including customizable and interchangeable drums. This description provides various components, one or more of which may be included in particular implementations of the reels. In illustrating and describing these various components, however, it is noted that implementations of the reels may include any combination of these components, including combinations other than those shown in this description.

Figure 1:
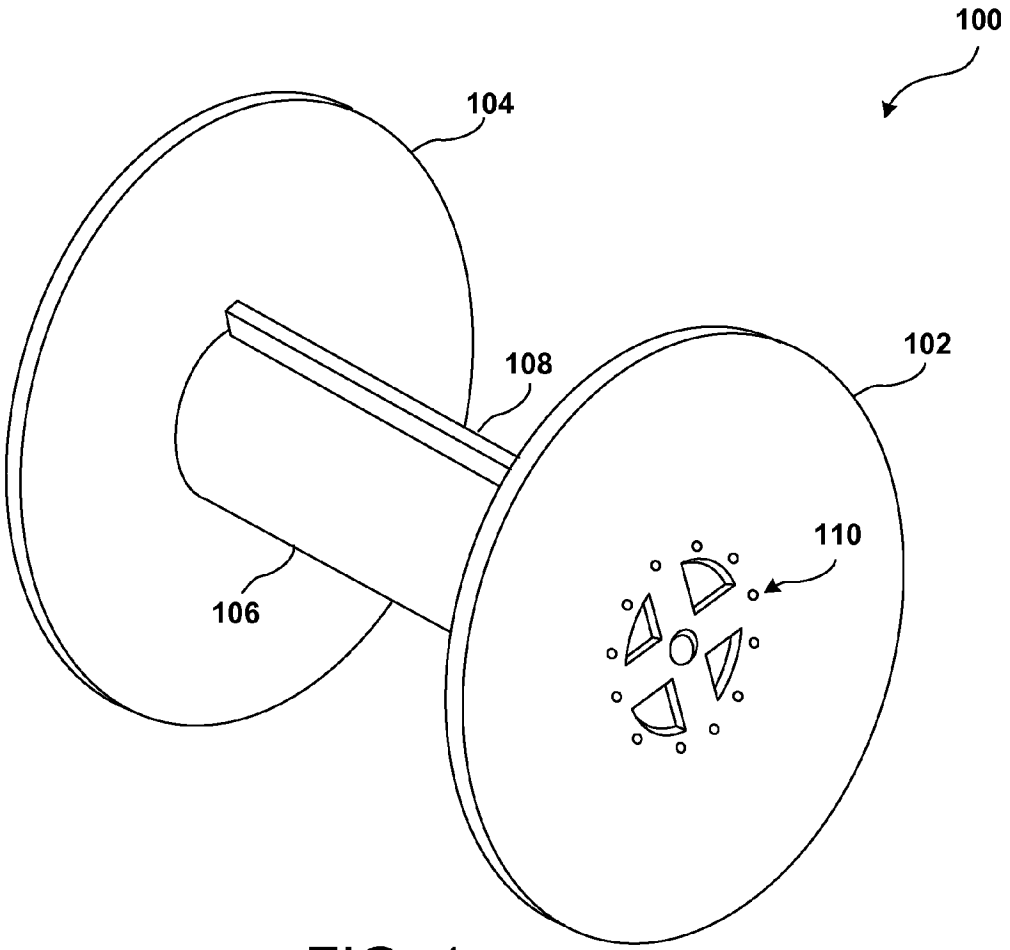
FIG. 1 is a perspective view of a reel assembly according to exemplary embodiments.

Turning now to FIG. 1, a reel 100 according to exemplary embodiments is illustrated. The reel 100 includes a core drum 106 connected at one end to a first flange 102 and at the other end to a second flange 104. According to exemplary embodiments, the core drum 106 has an outside diameter (OD) of 60". It should be appreciated by one skilled in the art that the OD of the core drum 106 may be smaller or larger and still be consistent with embodiments disclosed herein. The core drum 106 may be constructed of a rolled metal, such as rolled steel, or any other rigid material and may have a wall thickness of five-eighths inch.

Figure 2:
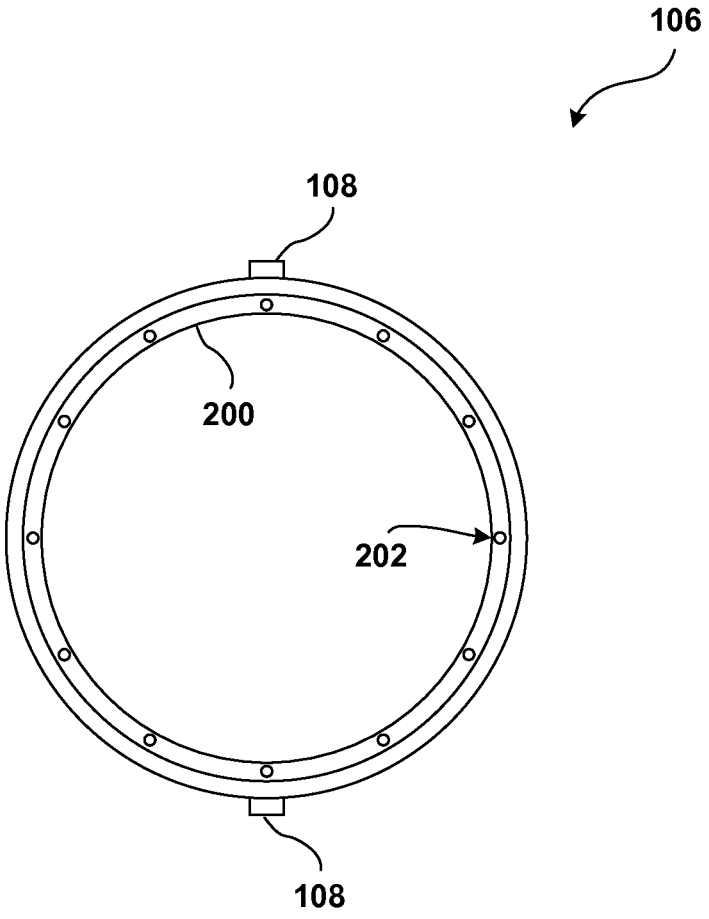
FIG. 2 is a side view of a core drum of the reel assembly according to exemplary embodiments.

As illustrated in FIG. 1, the first flange and the second flange 102, 104 include a bolt pattern 110, as illustrated on the first flange 102, including an arrangement of holes for receiving bolts to detachably couple the first flange 102 with one end of the core drum 106 and to detachably couple the second flange 104 with the opposite end of the core drum 106. The bolt pattern 110 may include twelve holes in a circular arrangement, as illustrated in FIG. 1. However, it should be appreciated by one skilled in the art that the bolt pattern 110 may include any number of holes arranged in any configuration to detachably couple the first flange 102 with one end of the core drum 106 and to detachably couple the second flange 104 with the opposite end of the core drum 106. As illustrated in FIG. 2 and discussed further below, the ends of the core drum 106 include a flange 200 having a bolt pattern 202 matching the bolt pattern 110 of the first and second flanges 102, 104 for coupling the core drum 106 with the first and second flanges 102, 104. Thus, the reel 100 can be assembled on demand by attaching the first flange 102 to one end of the core drum 106 via the bolt pattern 110 of the first flange 102 and the matching bolt pattern 202 of the core drum 106 and attaching the second flange 104 to the opposite end of the core drum 106 via the bolt pattern 110 of the second flange 104 and the matching bolt pattern 202 of the opposite end of the core drum 106.

Figure 7:
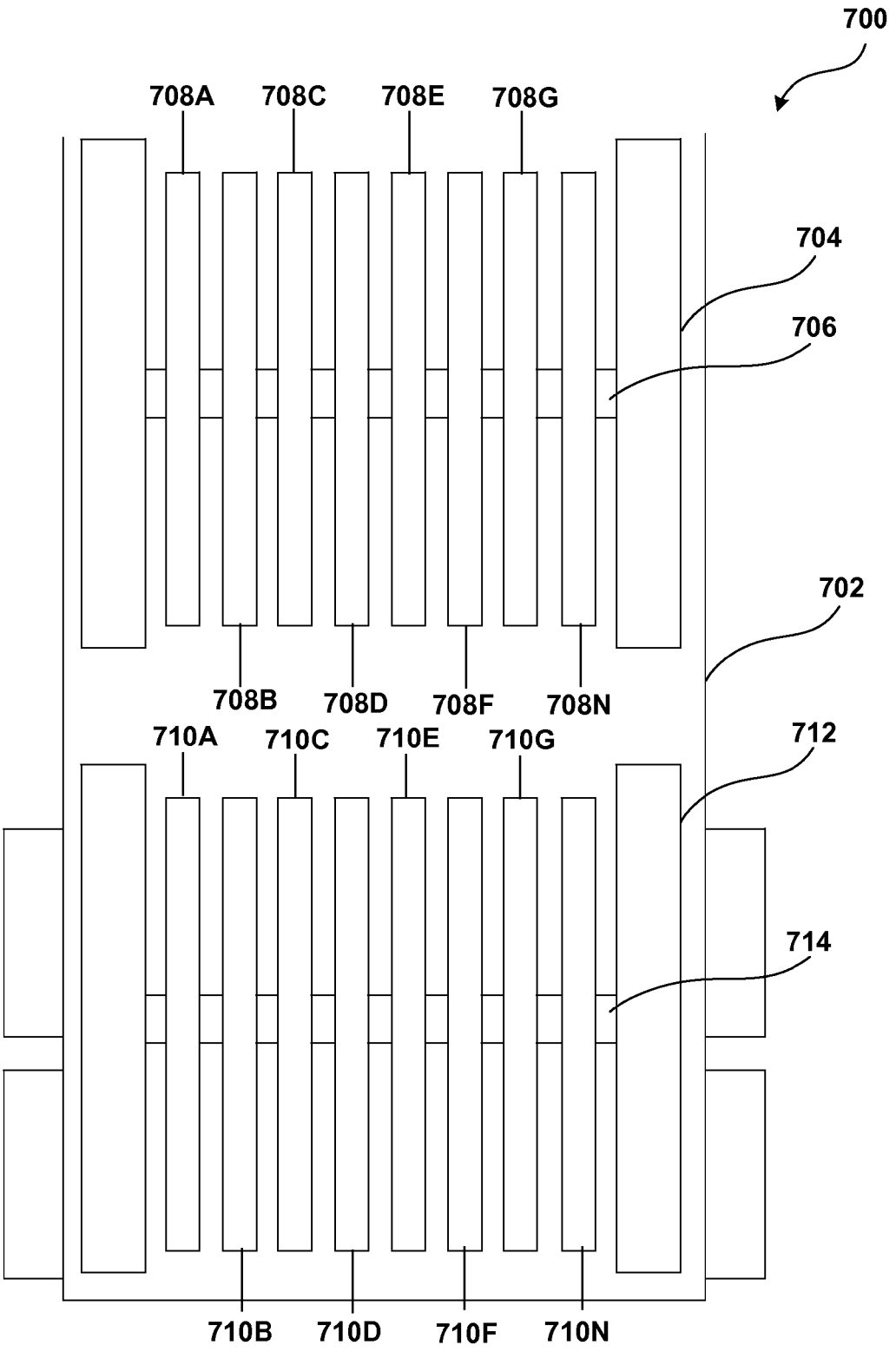
FIG. 7 is a top view of a transporter including support units holding multiple flanges of reel assemblies according to exemplary embodiments.
Figure 8:
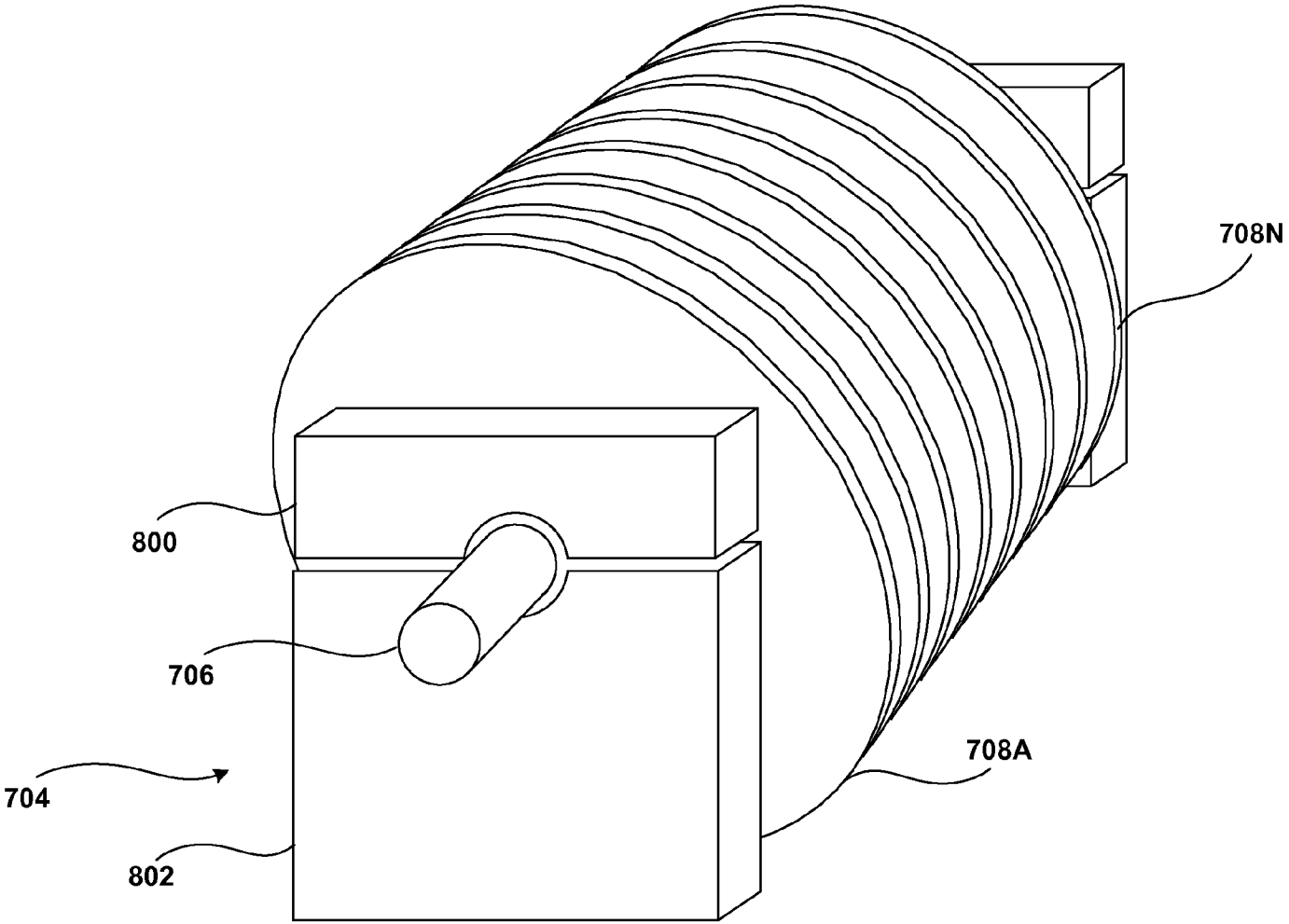
FIG. 8 is a perspective view of one of the support units holding multiple flanges of reel assemblies according to exemplary embodiments.

Similarly, the reel 100 can be disassembled by removing the first and second flanges 102, 104 from the core drum 106. Typically only a limited number of conventional reels, such as two, can be transported together on a transporter, such as a flatbed truck, once the wire, cable, conduit, or armored cable is unloaded from the reels. Although unloaded reels have a reduced weight which would allow many more to be carried on a single flatbed truck, the overall dimensions of the reel restrict the number of unloaded reels that can be carried. As illustrated in FIGS. 7-8, once reels, such as the reel 100 described herein, are disassembled, a plurality of flanges 708A-708N and 710A-710N disassembled from the reels can be carried on a single transporter 702 via, for example, support units 704 and 712, respectively. Thus, instead of only being able to transport two unloaded reels via the single transporter 702, 16-20 disassembled flanges may be transported by the single transporter, and the drums of the disassembled reels may also be transported via the single transporter and/or may be transported via a dry van.

As further illustrated in FIG. 8, the support units, such as the support unit 704, may include a bottom member 802 and a top member 800. The plurality of flanges 708A-708N may be loaded onto a rod 706 which is then positioned onto the bottom member 802 of the support unit 704. The top member 800 of the support unit 704 may then be positioned over the loaded rod 706 and secured to the bottom member 802 so as to hold the loaded rod 706 in place. In addition, the support unit 704 may be secured to the transporter 702 by bolting the bottom member 802 to the deck of the transporter 702 or chaining the support unit 704 to the bed of the transporter 702. The support units 704, 712 may be constructed of a metal, such as steel.

It should be appreciated by one skilled in the art that, for some embodiments, only one of the first and second flanges 102, 104 includes the bolt pattern 110 and that only one end of the core drum 106 includes the matching bolt pattern 202 for coupling the one flange 102, 104 to the core drum 106. The other end of the core drum 106 may be more permanently attached to the flange 102, 104 not including the bolt pattern 110, such as welded to the flange 102, 104.

The first and second flanges 102, 104 may be constructed of a metal, such as steel, or any other rigid material capable of supporting the core drum 106 and/or the assembly of the core drum 106 and an interchangeable drum 300, discussed further below in view of FIG. 3, when loaded with wire, cable, conduit, and/or armored cable. The diameter of the first and second flanges 102, 104 may be dictated by the OD of the core drum 106 and/or the OD of the interchangeable drum 300 when assembled over the core drum 106. For instance, if the core drum 106 of the reel 100 has an OD of 60", then the diameter of the first and second flanges 102, 104 may be around 110"; and if the assembly of the core drum 106 and the interchangeable drum 300 has an OD of 80" or greater, then the diameter of the first and second flanges 102, 104 may be from 138"-158". According to exemplary embodiments, all variations of diameter of the first and second flanges 102, 104 include the same bolt pattern 110 so that the reel 100 does not have to include additional holes for coupling to the core drum 106 which may damage any wire, cable, conduit, or armored cable loaded on the reel 100.

In accordance with further exemplary embodiments, the core drum 106 includes a locking member 108 extending from one end of the core drum to the other. The core drum 106 may include an additional locking member 108, as illustrated in FIG. 2, positioned ninety degrees from the locking member 108. As will be discussed further below, the locking members 108 of the core drum 106 fit within locking slots 308 of the interchangeable drum 300 extending from one end of the interchangeable drum 300 to the other such that when the interchangeable drum 300 is assembled over the core drum 106, the interchangeable drum 300 and the core drum 106 are locked together to restrict the interchangeable drum 300 from rotating around the core drum 106. The locking members 108 may also be constructed of a rolled metal such as rolled steel and may be a one-inch-by-one-inch square key welded to the core drum 106. It should be appreciated by one skilled in the art that the locking member 108 of the core drum 106 may include any mechanism to lock the core drum 106 and the interchangeable drum 300 together to restrict the interchangeable drum 300 from rotating around the core drum 106.

As discussed above, wire, cable, conduit, or armored cable to be loaded on a reel typically has a bend factor which indicates the maximum each can bend before damage occurs. For instance, for some wire, cable, conduit, or armored cable, the bend factor is twenty-two times the OD of the wire, cable, conduit, or armored cable. Using this particular bend factor, the OD of the interchangeable drum 300 of the reel 100 must be at least twenty-two times the OD of the wire, cable, conduit, or armored cable to protect from damaging the wire, cable, conduit, or armored cable when loaded on the reel 100. For example, if a particular wire has an OD of 4", then the interchangeable drum 300 of the reel 100 for which the particular wire is to be loaded must have an OD of at least 88". It should be appreciated that any bend factor associated with a particular wire, cable, conduit, or armored cable is supported by the embodiments disclosed herein. Reel suppliers may only be able to stock reels having drums of a limited OD variety which often causes a supplier to use a bigger reel, such as one having 138" flanges, than is actually necessary to load particular wire, cable, conduit, or armored cable. As further discussed above, the larger the reel, the higher the cost of transporting the reel. Exemplary embodiments described herein provide a reel assembly having interchangeable drums which have ODs that are customizable to the OD size of the particular wire, cable, conduit, or armored cable to be loaded. Therefore, reels 100 having appropriate flange diameters based on the wire, cable, conduit, or armored cable being loaded on the reel 100 can be used, which may reduce the transportation cost associated with the reels 100.

Turning now to FIG. 2, a side view of the core drum 106 according to exemplary embodiments is illustrated. As discussed above, the core drum 106 may include the locking members 108 that engage the locking slots 308 of the interchangeable drum 300 such that when the interchangeable drum 300 is assembled over the core drum 106, the interchangeable drum 300 and the core drum 106 are locked together to restrict the interchangeable drum 300 from rotating around the core drum 106. According to further embodiments, the core drum 106 includes the flange 200 having the bolt pattern 202 including an arrangement of holes which mimics the bolt pattern 110 of the first and second flanges 102, 104 so as to attach the first flange 102 to one end of the core drum 106 and the second flange 104 to the other end of the core drum 106. As discussed above, the core drum 106 may have an OD of 60". Although the core drum 106 may have a larger or smaller OD than 60", the bolt pattern 202 of the flange 200 of the core drum 106 remains consistent with the bolt pattern 110 of the first and second flanges 102, 104 so that the first flange 102 and the second flange 104 do not have to include additional holes for coupling to the core drum 106 which may damage any wire, cable, conduit, or armored cable loaded on the reel 100. The flange 200 may be constructed of a rolled metal similar to the core drum 106, such as rolled steel.

In order to customize the reel 100 for receiving wire, cable, conduit, or armored cable having a variety of ODs, exemplary embodiments provide an interchangeable drum, such as the interchangeable drum 300, for assembling over the core drum 106. The interchangeable drum 300, as illustrated in FIG. 3, may include an outer wall 302 and an inner wall 304. In accordance with exemplary embodiments, the inner wall 304 of the interchangeable drum 300 has an inner diameter (ID) slightly greater than the OD of the core drum 106 such that when the interchangeable drum 300 is assembled over the core drum 106, only a small amount of space exists between the inner wall of the interchangeable drum 300 and the core drum 106. For example, if the OD of the core drum 106 is 60", then the ID of the inner wall 304 of the interchangeable drum 300 is 61". According to exemplary embodiments, the inner wall 304 also defines the locking slots 308 which, as described above, receive the locking members 108 of the core drum 106 such that when the interchangeable drum 300 is assembled over the core drum 106, the interchangeable drum 300 and the core drum 106 are locked together to restrict the interchangeable drum 300 from rotating around the core drum 106.

The outer wall 302 of the interchangeable drum 300 may have any OD greater than the OD of the inner wall 304 of the interchangeable drum 300. According to exemplary embodiments, the OD of the outer wall 302 of the interchangeable drum 300 is dictated by the OD of the wire, cable, conduit, or armored cable to be loaded around the outer wall of the interchangeable drum 300. Thus, the interchangeable drum 300 is customizable based on the OD of whatever is to be loaded on the interchangeable drum 300. For example, if a particular wire has an OD of 3.125", then the outer wall 302 of the interchangeable drum 300 would have an OD of 68.75", assuming that the particular wire has a bend factor of twenty-two times the OD of the particular wire. The outer wall 302 and the inner wall 304 of the interchangeable drum 300 may be constructed of a rolled metal, such as rolled steel, or any other rigid material and may each have a wall thickness of five-eighths inch.

Figure 3:
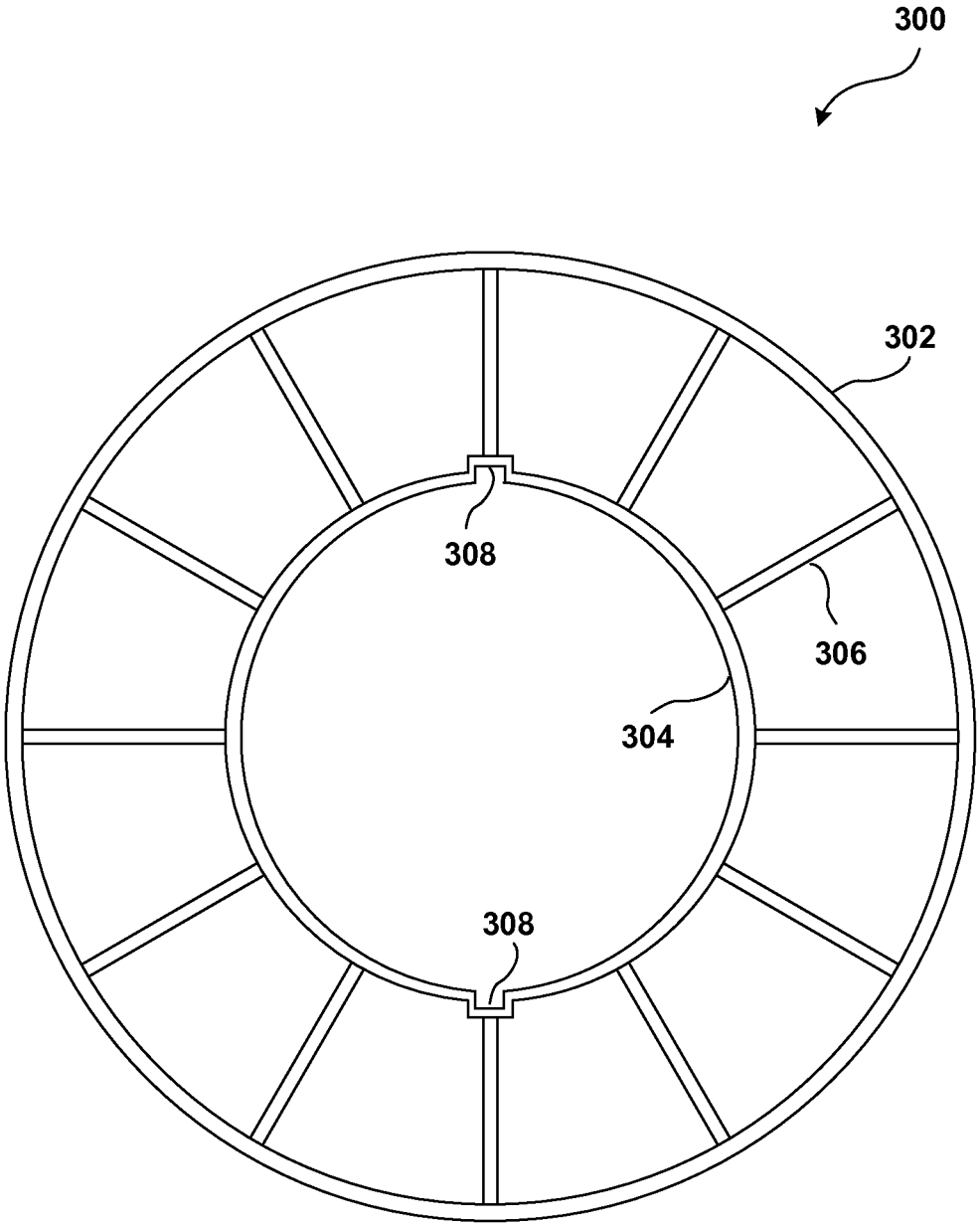
FIG. 3 is a side view of an interchangeable drum of the reel assembly according to exemplary embodiments.

In accordance with exemplary embodiments and as illustrated in FIG. 3, the interchangeable drum 300 includes support members 306 positioned between the outer wall 302 and the inner wall 304 of the interchangeable drum 300 to separate the outer wall 302 and the inner wall 304 and reinforce the rigidity of the interchangeable drum 300. The support members 306 may be round or square pieces of rigid material, such as metal, each having a first end attached, such as via a weld, to the outer wall 302 and a second end attached, such as via a weld, to the inner wall 304 of the interchangeable drum 300. The support members 306 may be positioned between the outer wall 302 and the inner wall 304 such that the support members 306 are evenly spaced, as illustrated in FIG. 3, or the support members 306 may be positioned between the outer wall 302 and the inner wall 304 in a V-shaped pattern. It should be appreciated that any other layouts of the support members 306 between the outer wall 302 and the inner wall 304 such that the support members 306 separate the outer wall 302 and the inner wall 304 and reinforce the rigidity of the interchangeable drum 300 are supported.

Figure 4:
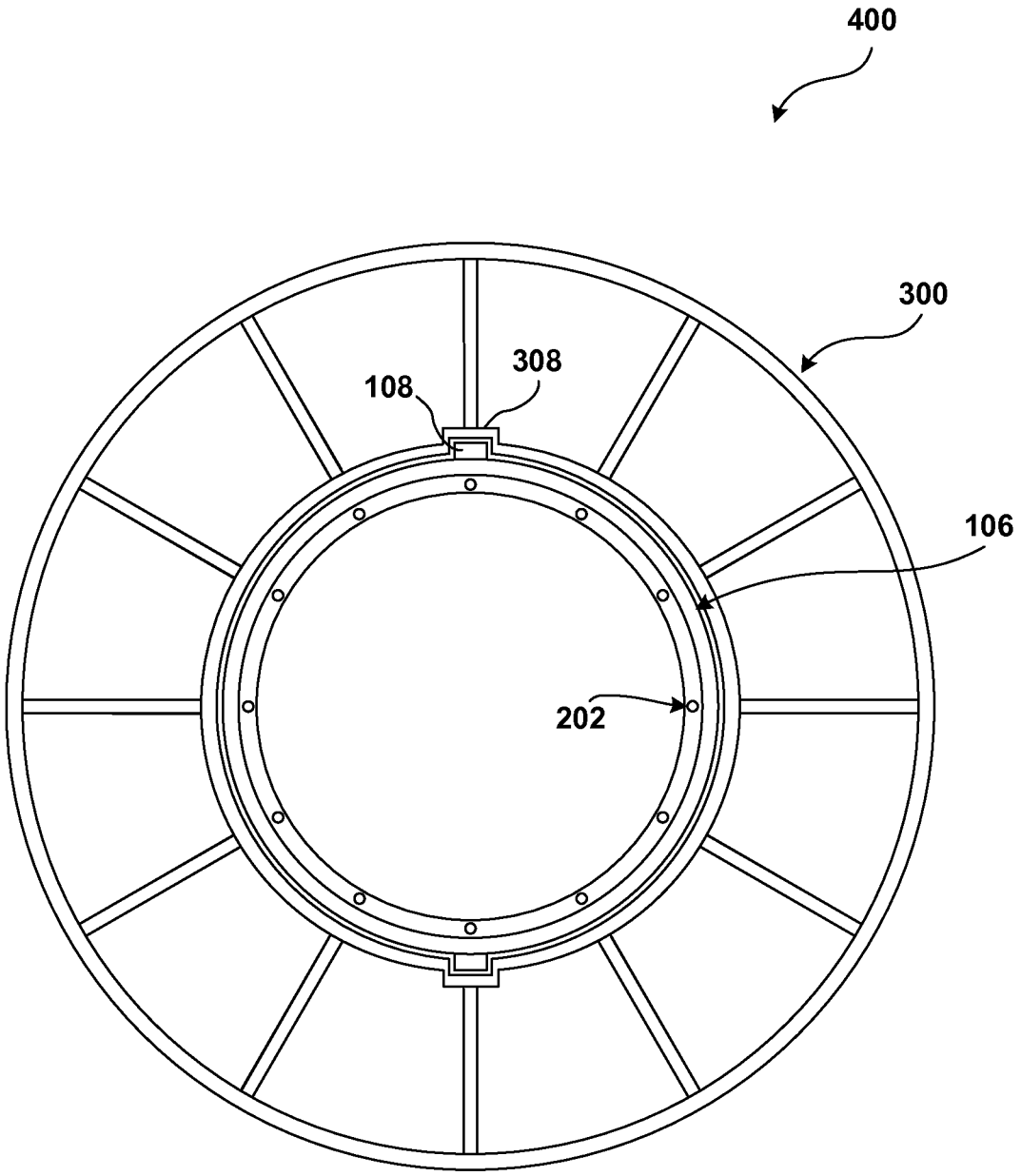
FIG. 4 is a side view of an assembled drum including the interchangeable drum assembled over the core drum so as to couple the interchangeable and core drums together according to exemplary embodiments.

Turning now to FIG. 4, an assembled drum 400 according to exemplary embodiments is illustrated. The assembled drum 400 includes the interchangeable drum 300 positioned around the core drum 106. Additionally, the assembled drum 400 includes the bolt pattern 202 of the core drum 106. In accordance with exemplary embodiments, the interchangeable drum 300 is slid over the core drum 106 to achieve the assembled drum 400. In particular, the locking slots 308 of the interchangeable drum 300 are aligned with the locking members 108 of the core drum 106 such that the locking members 108 are received into the locking slots 308 to secure the interchangeable drum 300 and the core drum 106 together to restrict the interchangeable drum 300 from rotating around the core drum 106 once assembled, and the core drum 106 is received within the space defined by the inner wall 304 of the interchangeable drum 300.

Figure 5:
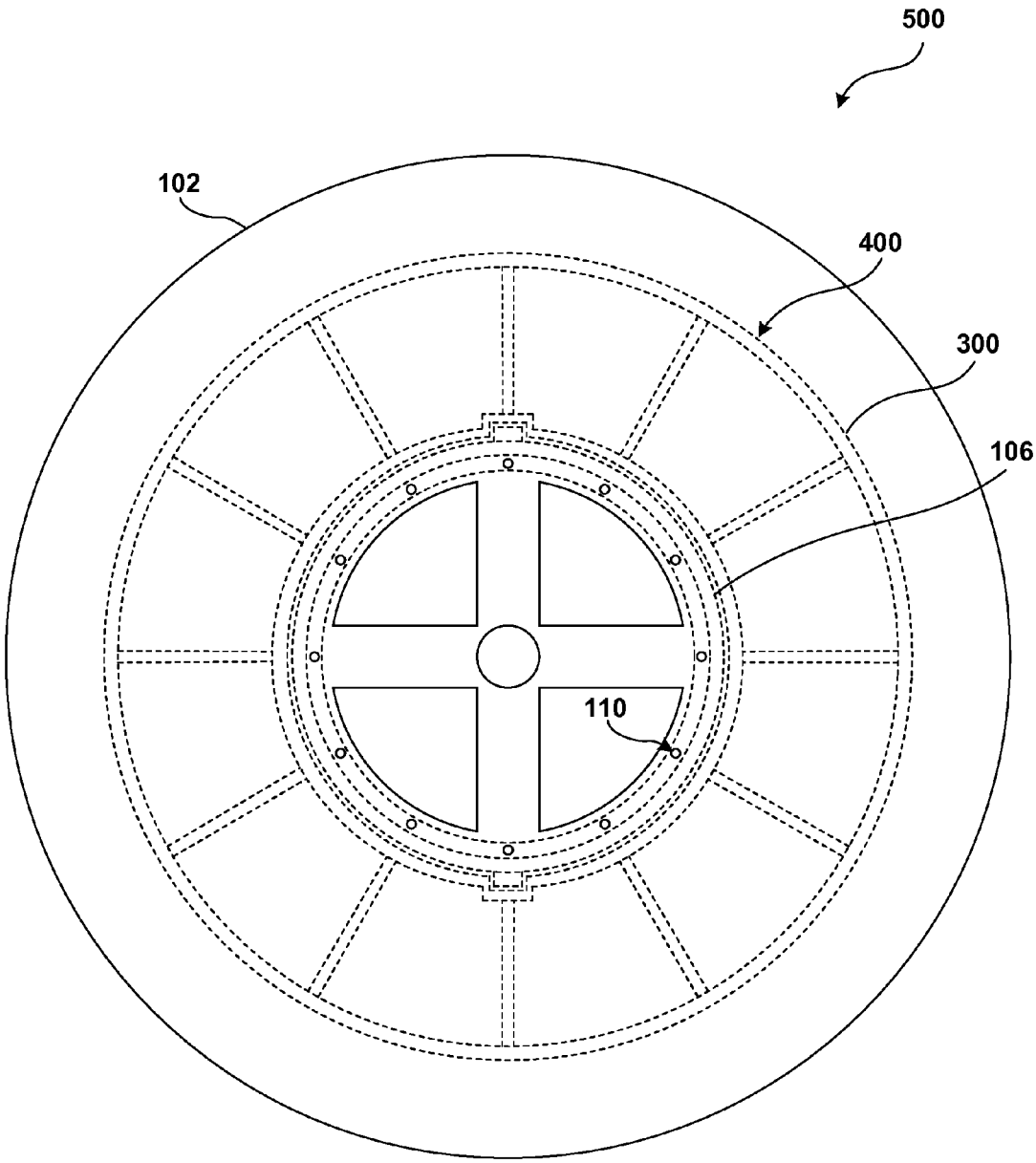
FIG. 5 is a side view of an assembled reel including the core drum and the interchangeable drum according to exemplary embodiments.
Figure 6:
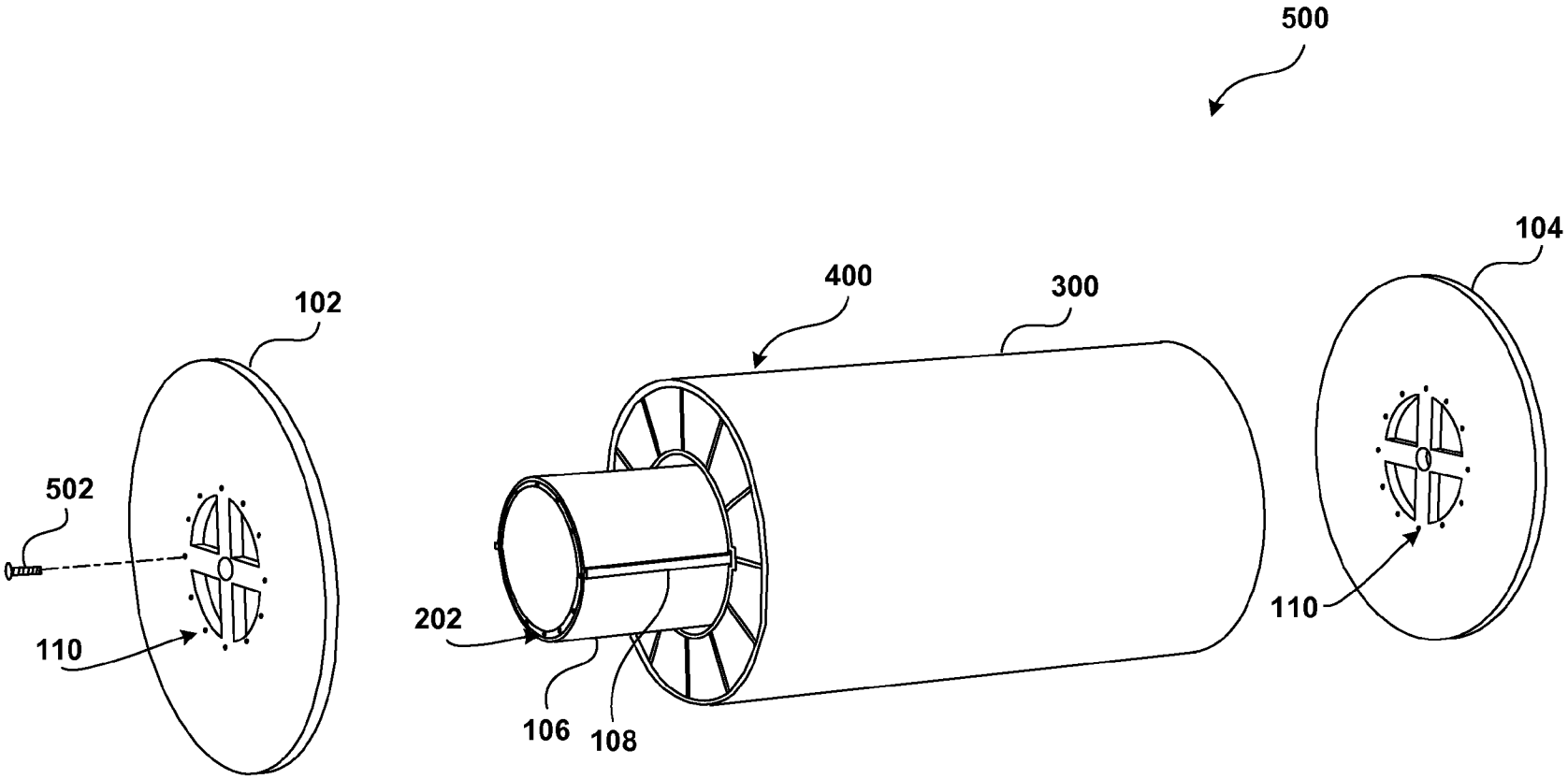
FIG. 6 is a partially exploded view of the assembled reel according to exemplary embodiments.

Further, FIG. 5 illustrates an assembled reel 500 according to exemplary embodiments. The assembled reel 500 includes the assembled drum 400 illustrated in FIG. 4 attached to the first flange 102 and the second flange 104 (not shown). In order to attach the assembled drum 400 to the first and second flanges 102, 104, the bolt pattern 202 at each end of the core drum 106 of the assembled drum is aligned with the matching bolt pattern 110 of the first and second flanges 102, 104. Once the bolt patterns 110, 202 are aligned, bolts, screws, or other securing members 502 (FIG. 6) are inserted into the holes of the bolt patterns 110, 202 to detachably couple the first and second flanges 102, 104 to the assembled drum 400. It should be appreciated that one end of the core drum 106 may be attached to the first flange 102 before the interchangeable drum 300 is slid over the core drum 106 to form the assembled drum 400. The second flange 104 can then be attached to the end of the assembled drum 400. FIG. 6 provides a partially exploded view of the assembled reel 500 further illustrating exemplary embodiments of the components of the assembled reel 500 and assembly of the assembled reel 500. Since the assembled reel 500 can be disassembled and reassembled to include an interchangeable drum 300 having any OD greater than 60", the assembled reel 500 is customizable based on the OD of the wire, cable, conduit, or armored cable to be loaded on the assembled reel 500.

Figure 9:
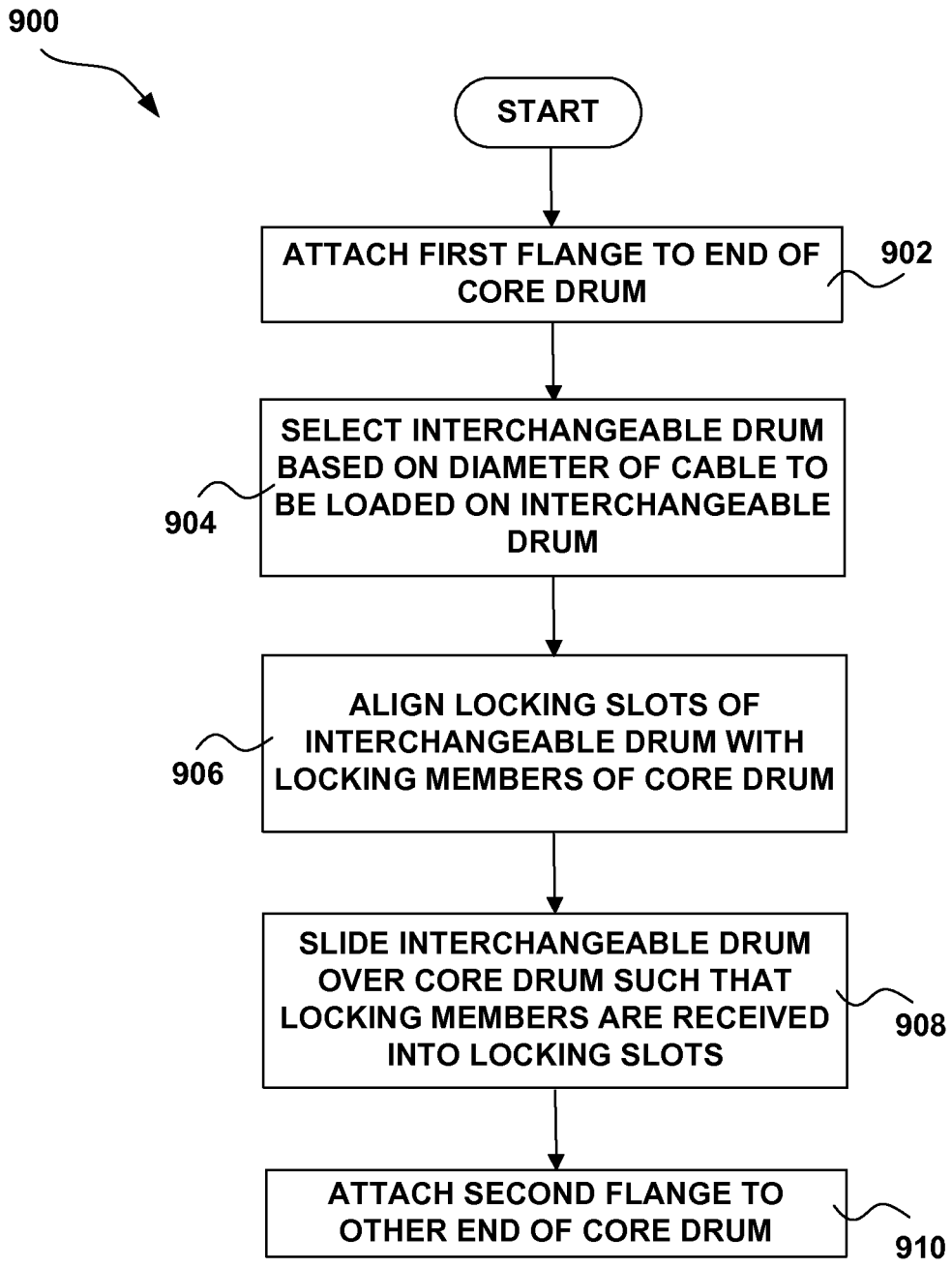
FIG. 9 is a flowchart illustrating aspects of assembling the reel assembly according to exemplary embodiments.

Turning now to FIG. 9, a method 900 for assembling the assembled reel 500 according to exemplary embodiments is provided. At operation 902, the first flange 102 is attached to one end of the core drum 106 via the bolt pattern 110 of the first flange 102 and the matching bolt pattern 202 of the core drum 106. In order to attach the first flange 102 to the core drum 106, the bolt pattern 202 at the one end of the core drum 106 is aligned with the matching bolt pattern 110 of the first flange 102. Once the bolt patterns 110, 202 are aligned, bolts, screws, or other securing members 502 are inserted into the holes of the bolt patterns 110, 202 to detachably couple the first flange 102 to the core drum 106.

At operation 904, an interchangeable drum, such as the interchangeable drum 300, is selected to assemble over the core drum 106 based on the OD of whatever is to be loaded on the interchangeable drum 300. As discussed above, the OD of the outer wall 302 of the interchangeable drum 300 is dictated by the OD of the wire, cable, conduit, or armored cable to be loaded around the outer wall 302 of the interchangeable drum 300. Thus, the interchangeable drum 300 is customizable based on the OD of whatever is to be loaded on the interchangeable drum 300.

At operation 906, the locking slots 308 of the interchangeable drum 300 selected to be assembled over the core drum 106 are aligned with the locking members 108 of the core drum 106, and then the interchangeable drum 300 is slid over the core drum 106, at operation 908, such that the locking members 108 of the core drum 106 are received into the locking slots 308 of the interchangeable drum 300 to secure the interchangeable drum 300 and the core drum 106 together to restrict the interchangeable drum 300 from rotating around the core drum 106 once assembled, and the core drum 106 is received within the space defined by the inner wall 304 of the interchangeable drum 300. At operation 910, the second flange 104 is attached to the opposite end of the core drum 106 via the bolt pattern 110 of the second flange 104 and the matching bolt pattern 202 of the core drum 106. In order to attach the second flange 102 to the core drum 106 over which the interchangeable drum 300 is positioned, the bolt pattern 202 at the opposite end of the core drum 106 is aligned with the matching bolt pattern 110 of the second flange 104. Once the bolt patterns 110, 202 are aligned, bolts, screws, or other securing members 502 are inserted into the holes of the bolt patterns 110, 202 to detachably couple the second flange 104 to the core drum 106 over which the interchangeable drum 300 is positioned.

The subject matter described above is provided by way of illustration only and should not be construed as limiting. Various modifications and changes may be made to the subject matter described herein without following the example embodiments and applications illustrated and described, and without departing from the true spirit and scope of the claimed subject matter, which is set forth in the following claims.

What is claimed is:

1. A reel assembly comprising:

a flange comprising a bolt pattern;

a core drum comprising a first end comprising the bolt pattern, wherein the first end is detachably coupled to the flange via the bolt pattern; and an interchangeable drum for assembling over the core drum, wherein the core drum comprises an outside diameter, wherein the interchangeable drum comprises an inner wall having an inner diameter and an outer wall having an outside diameter, the inner diameter of the interchangeable drum slightly larger than the outside diameter of the core drum and the outside diameter of the interchangeable drum larger than the inner diameter of the interchangeable drum, and wherein the outside diameter of the interchangeable drum is based on a diameter of a cable to be loaded on the interchangeable drum.

2. The reel assembly of claim 1, wherein the interchangeable drum further comprises at least one support member positioned between the inner wall of the interchangeable drum and the outer wall of the interchangeable drum.

3. The reel assembly of claim 1, wherein the core drum further comprises at least one locking member and wherein the interchangeable drum comprises at least one locking slot for receiving the at least one locking member of the core drum when the interchangeable drum is assembled over the core drum.

4. The reel assembly of claim 3, wherein the at least one locking member of the core drum extends from the first end of the core drum to a second end of the core drum and wherein the at least one locking slot of the interchangeable drum extends from a first end of the interchangeable drum to a second end of the interchangeable drum.

5. The reel assembly of claim 1, further comprising a further interchangeable drum, wherein the further interchangeable drum is assembled over the core drum after the interchangeable drum is disassembled from the core drum, the further interchangeable drum having a different outside diameter than the outside diameter of the interchangeable drum.

6. A method of configuring a reel assembly, the method comprising:

attaching a flange to a first end of a core drum, the flange detachably coupled to the core drum via a bolt pattern shared by the flange and the first end of the core drum; and assembling an interchangeable drum over the core drum, wherein assembling the interchangeable drum over the core drum comprises:

selecting the interchangeable drum having a particular outside diameter based on a diameter of a cable to be loaded on the interchangeable drum, and sliding a locking member of the core drum into a locking slot of the interchangeable drum selected.

7. The method of claim 6, further comprising detaching the flange from the core drum for transporting the flange.

8. The method of claim 7, further comprising reattaching the flange to the core drum after transporting the flange.

* * * * *